United States Patent [19]

Obrist

[11] 4,254,603

[45] Mar. 10, 1981

[54] PROCESS AND APPARATUS FOR SCREWING ON A SCREW CAP

[75] Inventor: Albert Obrist, Reinach, Switzerland

[73] Assignee: Albert Obrist AG, Switzerland

[21] Appl. No.: 39,966

[22] Filed: May 17, 1979

[30] Foreign Application Priority Data

May 17, 1978 [CH] Switzerland ..... 5317/78

[51] Int. Cl.[3] ..... B67B 3/20

[52] U.S. Cl. ..... 53/490; 53/331.5

[58] Field of Search ..... 53/331.5, 317, 490

[56] References Cited

U.S. PATENT DOCUMENTS 2,610,779 9/1952 Fouse ..... 53/317 X 3,771,284 11/1973 Boeckmann et al. ..... 53/331.5 X

*Primary Examiner*—Travis S. McGehee

*Attorney, Agent, or Firm*—Larson, Taylor and Hinds

[57] ABSTRACT

Conventional heads for screwing bottle closures on to bottles generally are applied to the closure cap, while rotating at full speed which causes tipping of and damage to the closure cap. The invention seeks to overcome this disadvantage by a sleeve portion at the bottom of the fitting head first being applied without any torque to the closure cap, the sleeve portion being force-lockingly engaged with the rotating head only when the head is moved further downwardly through the clutch-engagement distance. When a maximum torque, which can be adjusted by means of a stressing spring, has been reached, the clutch begins to slip and the sleeve portion stops. The sleeve portion is of low mass so that after disengagement of the clutch, no additional torque due to inertia is applied to the closure cap.

7 Claims, 3 Drawing Figures

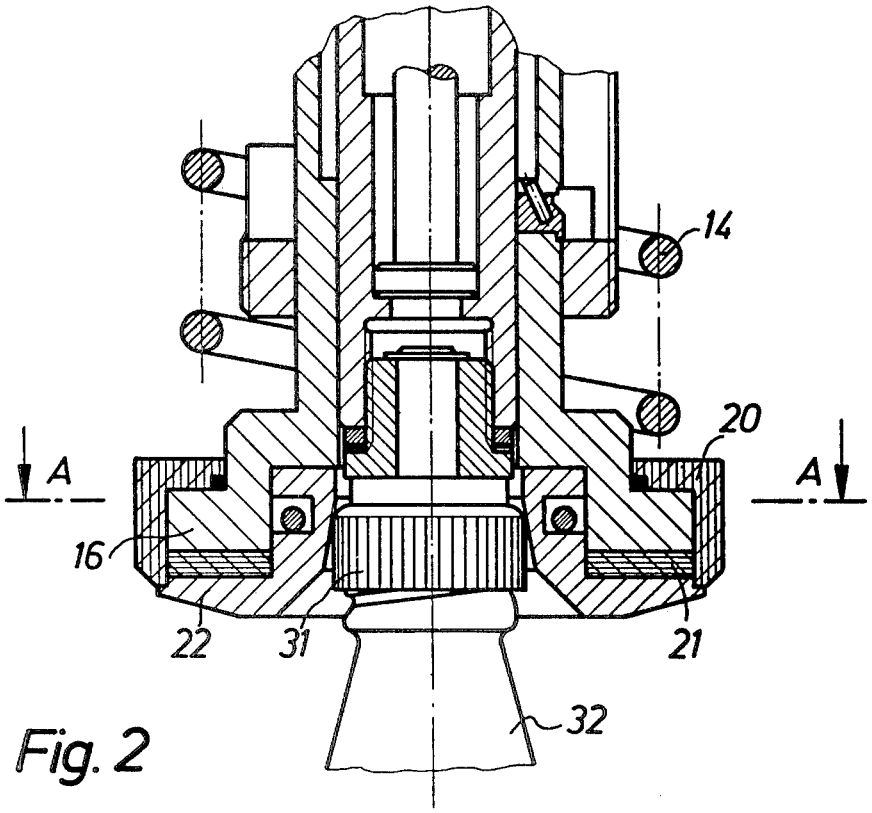
Fig. 2
Fig. 3
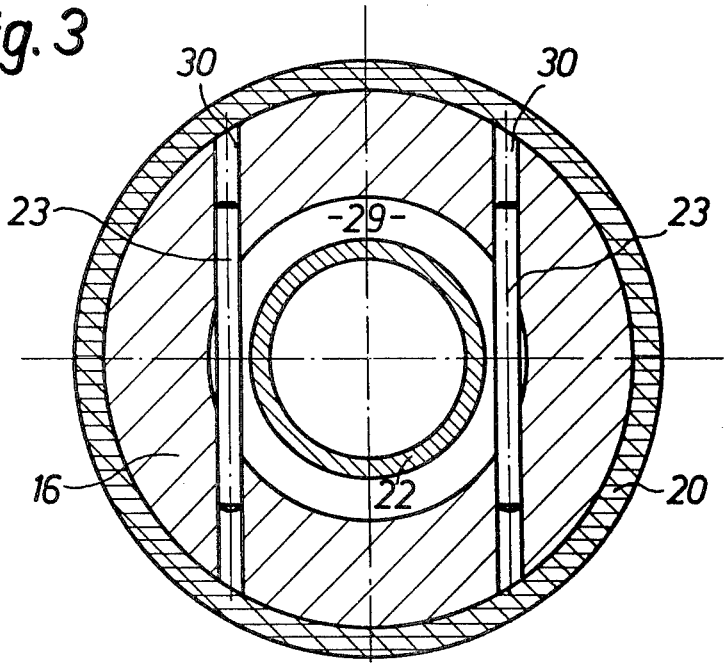

PROCESS AND APPARATUS FOR SCREWING ON A SCREW CAP

FIELD OF THE INVENTION

This invention is concerned with apparatus for screwing a cap on to the mouth of a bottle.

BACKGROUND OF THE INVENTION

Known apparatus for this purpose comprises a sleeve portion which is capable of being brought into engagement with the closure cap, drive means for driving a head portion which is capable of being connected to the sleeve portion by a slipping clutch to limit the torque which can be transmitted, and means for lowering the head portion and the sleeve portion on to the screw cap for carrying out the screwing operation.

Apparatuses of this kind are used primarily in the drinks industry, where there is a requirement for the bottles of drink to be closed by the bottler in as short a period of time, and in the most rational manner, possible. It is particularly important, in the bottle closure operation, for the closure cap to be screwed on to the bottle with only a limited torque, as otherwise the consumer cannot open the bottle by hand. In addition, if the torque applied is excessively high, there is a danger that the closure cap may be damaged when it is screwed on, with the result that the closure is not sealed.

The invention also relates to a process for screwing a screw cap on to the mouth of a bottle by apparatus having a sleeve portion which is capable of being brought into engagement with the closure cap, and a drive means. In this process, the completely filled bottles are moved, on an intermittently operated conveyor line, to a position aligned with the axis of the screwing-on apparatus, with the closure caps already loosely laid on the mouths of the bottles. The screwing-on head of the screwing-on apparatus is lowered on to the bottle and raised, after the screwing-on process has been completed, to permit the positioning of a fresh bottle to be closed with a screw cap.

Many different forms of screwing-on apparatus are already known in which the actual screwing-on head is force-lockingly connected to the drive means by a slippling clutch. Thus, for example German "Gebrauchsmuster" No. 71 48 902.6 discloses a screwing-on head wherein the lower part of the head, which is engaged with the screw cap, stops moving when a predetermined maximum torque is reached. In this arrangement, the slipping clutch comprises balls which are pressed by spring loading into corresponding recesses on the co-operating portion of the clutch. When the maximum torque is reached, the balls come out of the recesses so that the co-operating portion of the clutch comes to a halt.

A serious disadvantage of apparatus of this kind in that, when the head is lowered, the closure cap comes into contact therewith, whilst the entire apparatus is rotating at full speed. This is a serious disadvantage, in particular, with those closure caps which have an internal seal projecting into the mouth of the container. Such internal seals are in part-turned over rearwardly during the operation of fitting the cap in place, in order to provide a particularly good sealing action. This requires the screw cap to be pressed on to the mouth of the bottle in a particularly accurate manner, and also requires that the actual process of screwing the cap on to the bottle should be begun in a careful manner. This is not possible with the known apparatus, as the closure caps are easily tilted when the screwing-on process is immediately begun at full rotary speed of the apparatus, so that there is no longer any guarantee that the optimum sealing action will be achieved. In addition, because the fitting head is applied to the closure cap while rotating at full speed, wear phenomena can appear on the top of the cap, which have a disadvantageous effect, particularly when the surfaces of the cap bear printing.

A further disadvantage of most of the known forms of apparatus is that the lower part of the fitting head is of relatively large mass. As a result, the mass inertia which is produced by the rotary movement of the fitting head can cause undesired torque to be applied to the closure cap, even after the slipping clutch has become disengaged, and such undesired torque results in the above-described disadvantages.

The problem of the present invention is therefore that of avoiding the disadvantages of the known art and, in particular, of providing apparatus for screwing a screw cap on to the mouth of a bottle, which provides for a precise and careful start to the screwing-on process and wherein no undesired additional torques are applied to the cap after the screwing-on process has been completed.

SUMMARY OF THE INVENTION

According to the invention, in apparatus of this type, the clutch is provided in per se known manner with at least one clutch lining member arranged on an end face on the head portion and facing towards the rear of the sleeve portion, the sleeve portion is secured to the head portion so as to be freely rotatable and with vertical play, in such a way that the sleeve portion is pressed against the clutch lining member when the head portion is lowered on to a bottle provided with a screw cap, whereby the sleeve portion can be driven by the clutch lining member.

It will be seen that this arrangement makes it possible for the sleeve portion which fits around the screw cap to be brought into engagement with the screw cap, virtually without any torque being applied, at the beginning of the cap-fitting operation. It is only when the fitting apparatus is further lowered that the sleeve portion is force-lockingly coupled to the drive means.

The invention may be embodied in a particularly simple manner in apparatus in which the torque to be applied to the screw cap is limited by means of a spring acting on the slipping clutch. As different closure caps or bottle mouths also make different demands on the screwing-on apparatus from the point of view of the force involved, the torque to be transmitted to the screw cap can be determined by means of the spring. This can be effected in a particularly simple manner by selecting a suitable spring characteristic or by prestressing the spring.

In order to provide that the sleeve portion is not force-lockingly coupled to the drive means before the apparatus is brought into the clutch-engaged condition, at least a part of the sleeve portion is engaged positively, and axially displaceably over a distance corresponding to the clutch-engagement travel, into a part of the clutch which is force-lockingly connected to the drive means, means being provided for limiting the axial movement of the sleeve relative to the clutch.

This arrangement may be embodied in a particularly simple manner by a part of the sleeve portion, which engages into the clutch, being of substantially cylindrical configuration and being provided with a peripheral groove, by the clutch having an opening corresponding to the cylindrical part of the sleeve portion, and by pins being secured to the side wall of the opening and engaging into the peripheral groove in the sleeve portion, for limiting the axial movement.

The sleeve portion which is secured in this way to the underside of the drive means is pulled downwardly by the force of gravity so that the clutch is not force-locking engaged and the sleeve portion only hangs lossely in the pins of the driven clutch portion. This arrangement has the advantage that the sleeve portion is of very low mass so that there is no possibility of inertia moments being applied to the cap after the clutch has been disengaged. In addition, the sleeve portion may be easily replaced at any time, without any necessity to dismantle the entire apparatus.

The process for operating the apparatus is characterised in that a vertically displaceable punch member which is arranged in the centre of the sleeve portion first presses the closure cap on to the mouth of the bottle, that subsequently the sleeve portion which is still not force-lockingly connected to the drive means is brought into engagement with the closure cap on the mouth of the bottle, and that the sleeve portion is then connected to the drive means by means of an engageable clutch for limiting the torque to be transmitted.

This process has the advantage that the screw cap is firstly pressed against the mouth of the bottle, by relatively low vertical pressure. The sleeve portion which is subsequently applied to the screw cap cannot tip or damage the screw cap, as the sleeve portion is not at that time force-lockingly connected to the drive means.

The actual torque which starts the operation of screwing the cap on to the mouth of the bottle is applied only when the sleeve portion is already firmly engaged around the closure cap. This arrangement provides that the process of screwing the cap on to the mouth of the bottle is begun in such a manner that the closure cap is particularly preserved from damage, with the closure cap first being pressed on to the mouth of the bottle in a precisely horizontal position.

BRIEF DESCRIPTION OF THE DRAWINGS

In the accompanying drawings,

FIG. 2 is a somewhat simplified cross-section of the apparatus, during the operation of screwing on the screw cap, and FIG. 3 is a cross-section taken along line A—A of FIG. 2.

DESCRIPTION OF THE PREFERRED EMBODIMENT

Figure 1:
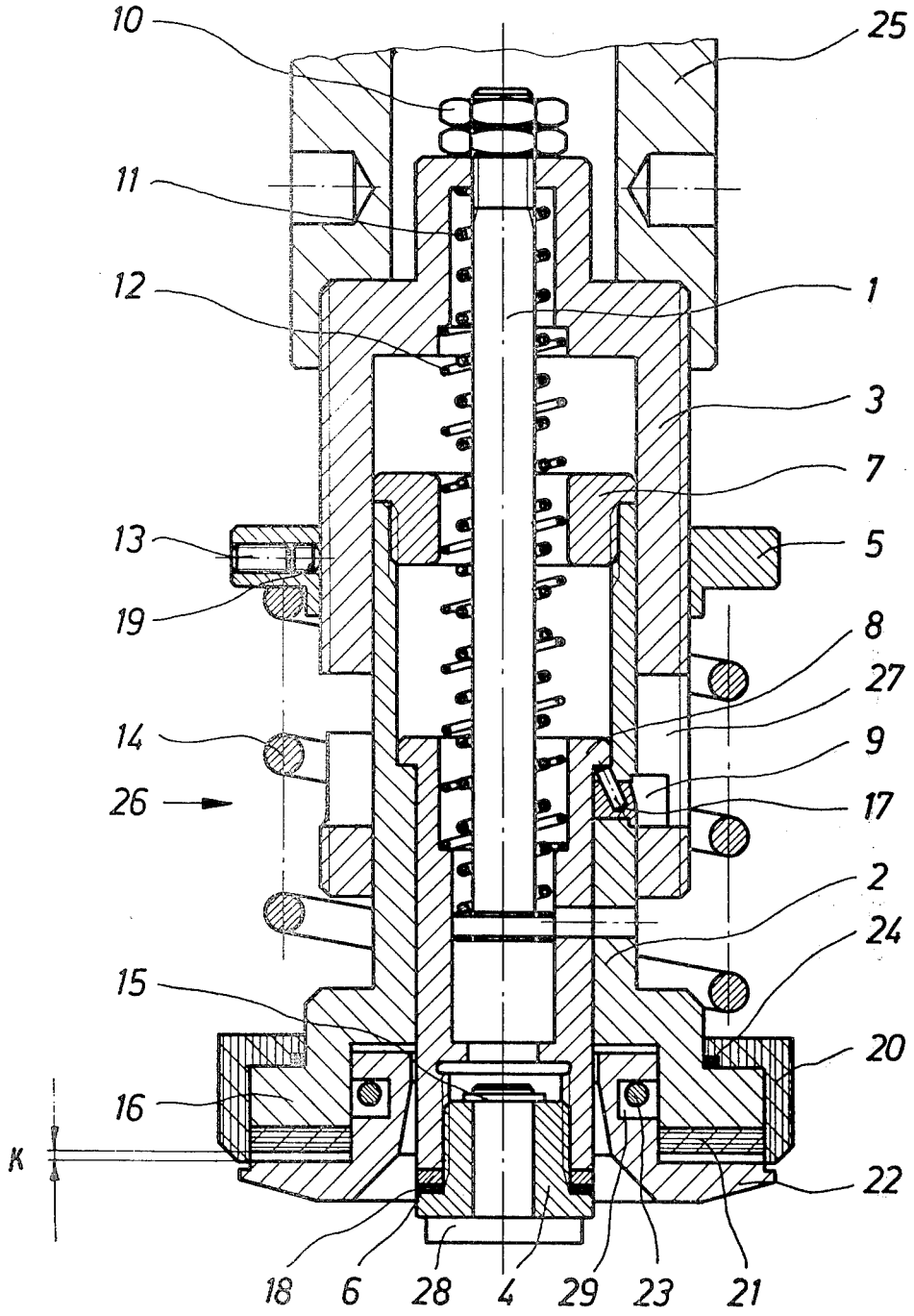
FIG. 1 is a cross-section through one form of apparatus according to the invention, before the operation of screwing a cap on to a bottle.

Referring to FIG. 1, the fitting head 26 of the apparatus is fixedly secured to a drive means 25 by screw means. The head 25 comprises a screw-threaded sleeve 3 and a head portion 2 provided with a clutch ring 16 at its lower end. The head portion 2 engages concentrically into the screw-threaded sleeve 3 and is axially displaceable relative thereto. The stroke of the head portion 2 in the sleeve 3 is limited by entrainment means 9 which can move in a slot 27 in the sleeve 3.The entrainment means 9 is fixedly connected to the head portion by a split pin or cotter pin 17 and serves also to form a positive connection in the rotary direction between the head portion 2 and the sleeve 3.

Mounted within the head portion 2 is a punch sleeve 8 which is axially displaceable and rotationally displaceable with respect to the head portion 2. The punch sleeve 8 is urged downwardly with relatively low force by a spring 12. When the punch sleeve 8 is moved upwardly against the force of the spring 12, the punch sleeve 8 comes into contact with a travel limiting means 1 which in turn can be displaced upwardly against the force of an additional spring 11. The height at which the punch sleeve 8 comes into contact with the stroke limiting means 1 can be adjusted by means of two nuts 10 at the upper end of the stroke limiting means 1.

At its lower end, the punch sleeve 8 is provided with a punch member 4 which in turn carries a mushroom-shaped contact member 28 which is held in the punch member 4 by a retaining ring 15. A support washer 18 is provided between the punch member 4 and the sleeve 8.

At its top, the head portion 2 is closed by a screw bush 7 which also serves to centre the spring 12. A clutch lining member 21 is secured to the bottom end face of the clutch ring 16. A sleeve portion 22 provided for engaging around the closure cap, engages concentrically into the head portion 2 and is axially displaceable therein. The stroke of the sleeve portion 22 relative to the clutch ring 16 is restricted by pins 23 which are secured tangentially to the inside wall surface of the clutch ring 16. The pins 23 engage into a peripheral annular groove 29 on the sleeve portion 22. The height of the annular groove 29 is such that the sleeve portion 22 can be axially displaced relative to the clutch ring 16, at least by the clutch engagement distance K.

In order to prevent fouling of the clutch surfaces, a nylon ring 20 engages over the clutch ring 16 and the clutch lining member 21 and in part also over the sleeve 22. In order to ensure that any lubricating oil which runs along the walls of the head 26 cannot get between the clutch faces, the nylon ring 20 is sealed with respect to the ring 16 by a sealing ring 24.

The manner in which the sleeve portion 22 is secured in the head portion 2 is particularly clearly shown in FIG. 3. The pins 23 are fitted into bores 30 which extend tangentially past the inside wall surface of the clutch ring 16. Before the operation of screwing a cap on to a bottle is begun, the sleeve portion 22 lies loosely on the top of the pins 23 and is only slightly moved with the head portion 2, by virtue of the friction between the pins and the inside surface of the annular groove 29.

In order to fit a closure cap 31 on to a bottle 32, the bottle 32 is first moved into a position in whih it is disposed concentrically below the head 26. The closure cap 31 is already loosely fitted on to the mouth of the bottle when this positioning operation takes place. Subseqently, the entire rotating head 26 is moved downardly, with the contact portion 28 first coming into contact with the top of the closure cap. When the head 26 is moved further downwardly, the punch sleeve 8 is displaced upwardly against the force of the spring 12. At this stage of the operation, the cap 31 is pressed against the mouth of the bottle, in a precise horizontal position. When the head 26 is moved further downwardly, the sleeve portion 22 engages around the closure cap 31. However, no torque is applied to the cap 31 for the time being, as the sleeve portion is still not force-lockingly connected to the head 26 which is rotating at full speed. It is only when the head 26 has been completely lowered that the clutch lining member 21 comes into contact with the sleeve portion 22, as shown in FIG. 2, whereby torque begins to be applied to the closure cap 31.

When the screw cap 31 reaches its final position on the bottle 32, the screw cap sets up a force resisting the rotational forces applied to the outside wall of the screw cap, so that the torque rises. In order to ensure that the cap 31 is not over-tightened on the bottle, the maximum torque which can be transmitted by the clutch can be adjusted by means of a stressing spring 14. The torque which can be transmitted by the clutch is determined by the coefficient of friction at the clutch lining member 16 and by the force exerted on the clutch by the spring 14.

This force can be adjusted as desired by displacement of the limiting ring 5. The ring 5 can be displaced along the outside of the sleeve 3 and secured in position by a grub screw 19 in the screw-threaded hole 13.

As soon as the maximum torque at the slipping clutch, as determined by the spring 14, is reached, the clutch begins to slip and the sleeve portion 22 ceases to rotate. As the sleeve portion 22 itself is of very low mass, there is no danger of an undesired additional torque being applied to the cap 31 by virtue of the inertia moment of the sleeve portion 22, after the clutch has moved into the disengaged position.

It will be appreciated that the effect according to the invention may also be achieved by other equivalent means, without thereby departing from the subject of the invention. Thus, it would be possible for example to use an electromagnetic clutch instead of the slipping clutch, the electromagnetic clutch being activated only after the sleeve portion 22 has been applied to the closure cap 31. The nature of the movable connection between the sleeve portion 22 and the lower part of the clutch may also be varied as desired.

I claim:

1. In apparatus for screwing a screen cap on to the mouth of a bottle, comprising a sleeve portion adapted to be brought into engagement with the screw cap, drive means for driving a head portion connected to said sleeve portion by a slipping clutch for limiting the torque which can be transmitted, and means for lowering the head portion and the sleeve portion on to the screw cap to carry out the screwing operation, the improvement wherein the clutch is provided with at least one clutch lining member arranged on an end face on the head portion and facing toward an oppositely facing part of the sleeve portion, the sleeve portion is secured to the head portion so as to be normally freely rotatable and with vertical play relative to the head portion with no appreciable torque transmitted therebetween, in such a way that the oppositely facing part of the sleeve portion is pressed against the clutch lining member by the sleeve portion only when the head portion is lowered on to a bottle provided with a screw cap with which said sleeve portion is in engagement, whereby the sleeve portion can be driven by the clutch lining member.

2. Apparatus as defined in claim 1, wherein the torque transmitted to the screw cap is limited by means of a spring acting on the slipping clutch.

3. Apparatus as defined in claim 2, comprising a prestressing spring against which said head portion can be telescopically compressed, said prestressing spring also limiting the torque transmitted to the screw cap.

4. Apparatus as claimed in claim 1 wherein said sleeve portion is mounted at the lower end of said head portion and said head portion is substantially continuously rotatably driven during operation, said mounting being such that said sleeve portion moves with said head portion relatively toward a bottle provided with a screw cap until said sleeve portion engages the screw cap, and thereafter the head portion moves relative to the sleeve portion and screw cap until said clutch lining member and said oppositely facing part of the sleeve member are pressed together to transmit screwing torque to said sleeve member and hence to the screw cap.

5. A process for screwing a screw cap on to the mouth of a bottle, by apparatus having a sleeve portion adapted to be brought into engagement with the closure cap, and drive means for said sleeve portion wherein a vertical punch member arranged in the center of the sleeve portion is first displaced to press the closure cap on to the mouth of the bottle, the sleeve portion whilst not force-lockingly connected to the drive means, but during operation of the drive means, is brought into engagement with the closure cap on the mouth of the bottle, such that no appreciable torque is transmitted to the sleeve portion or the closure cap, and the sleeve portion is then connected to the drive means by a normally disengaged engageable clutch which comes into engagement only after predetermined engagement of the sleeve portion with the closure cap and which limits the torque transmitted.

6. A process as claimed in claim 5 wherein said clutch comes into engagement only after predetermined movement of said drive means relatively toward said sleeve portion and a closure cap.

7. In apparatus for screwing a screw cap on to the mouth of a bottle, comprising a sleeve portion adapted to be brought into engagement with the screw cap, drive means for driving a head portion connected to said sleeve portion by a slipping clutch for limiting the torque which can be transmitted, and means for lowering the head portion and the sleeve portion on to the screw cap to carry out the screwing operation, the improvement wherein the clutch is provided with at least one clutch lining member arranged on an end face of the head portion and facing toward an oppositely facing part of the sleeve portion, the sleeve portion is secured to the head portion so as to be freely rotatable and with vertical play, in such a way that the oppositely facing part of the sleeve portion is pressed against the clutch lining member by the sleeve portion when the head portion is lowered on to a bottle provided with a screw cap, whereby the sleeve portion can be driven by the clutch lining member, said sleeve portion having a part of substantially cylindrical configuration projecting into the clutch and provided with a peripheral groove, said clutch has an opening corresponding to said cylindrical part of said sleeve portion, and pins secured to the side wall of said opening engage in said peripheral groove to limit axial movement of said sleeve portion.

* * * * *